United States Patent [19]

Suzuki

[11] 3,999,458

[45] Dec. 28, 1976

[54] ELECTRONIC MUSICAL INSTRUMENT HAVING PRESET ARRANGEMENT WITH ONE GROUP OF SWITCHES CONTROLLING TWO GROUPS OF MEMORIES

[75] Inventor: Shigeru Suzuki, Hamamatsu, Japan

[73] Assignee: Nippon Gakki Seizo Kabushishi Kaisha, Japan

[22] Filed: Aug. 13, 1975

[21] Appl. No.: 604,218

[30] Foreign Application Priority Data

Aug. 14, 1974 Japan ..... 49-92941

[52] U.S. Cl. ..... 84/1.01; 84/1.19; 84/1.24; 84/DIG. 2

[51] Int. Cl.[2] ..... G10H 1/02; G10H 5/02

[58] Field of Search ..... 84/1.01, 1.09–1.11, 84/1.17, 1.19–1.21, 1.24–1.27, DIG. 2, DIG. 8, DIG. 9

[56] References Cited

UNITED STATES PATENTS

| | | | |
|---|---|---|---|
| 3,538,804 | 11/1970 | George | 84/1.01 |
| 3,557,295 | 1/1971 | Adachi | 84/1.19 X |
| 3,570,357 | 3/1971 | Adachi | 84/1.26 |
| 3,571,481 | 3/1971 | Adachi | 84/1.13 |
| 3,828,110 | 8/1974 | Colin | 84/1.01 |
| 3,835,237 | 9/1974 | Adachi | 84/1.24 |
| 3,886,834 | 6/1975 | Okamoto | 84/1.17 |
| 3,886,836 | 6/1975 | Hiyoshi | 84/1.26 |
| 3,897,709 | 8/1975 | Hiyoshi et al. | 84/1.19 |
| 3,902,392 | 9/1975 | Nagahama | 84/1.01 |
| 3,902,396 | 9/1975 | Hiyoshi | 84/1.19 |

*Primary Examiner*—Stanley J. Witkowski
*Attorney, Agent, or Firm*—Flynn & Frishauf

[57] ABSTRACT

An electronic musical instrument comprising first and second musical tone signal synthesizing circuit arrangements including voltage waveform generators adapted to control first and second tone signals to be generated by the first and second musical tone signal synthesizing circuit arrangements. First and second memory groups including a plurality of waveform parameter controlling information memories are provided for control of the voltage waveform generators in the first and second musical tone signal synthesizing circuit arrangements. A memory selector includes the same number of preset switches as that of the memories in each of the first and second memory groups. When two preset switches are actuated, one corresponding memory in the first memory group and the other corresponding memory in the second memory group are selectively enabled according to a preselected preference order to couple waveform parameter controlling information to the first and second musical tone signal synthesizing circuit arrangements.

7 Claims, 6 Drawing Figures

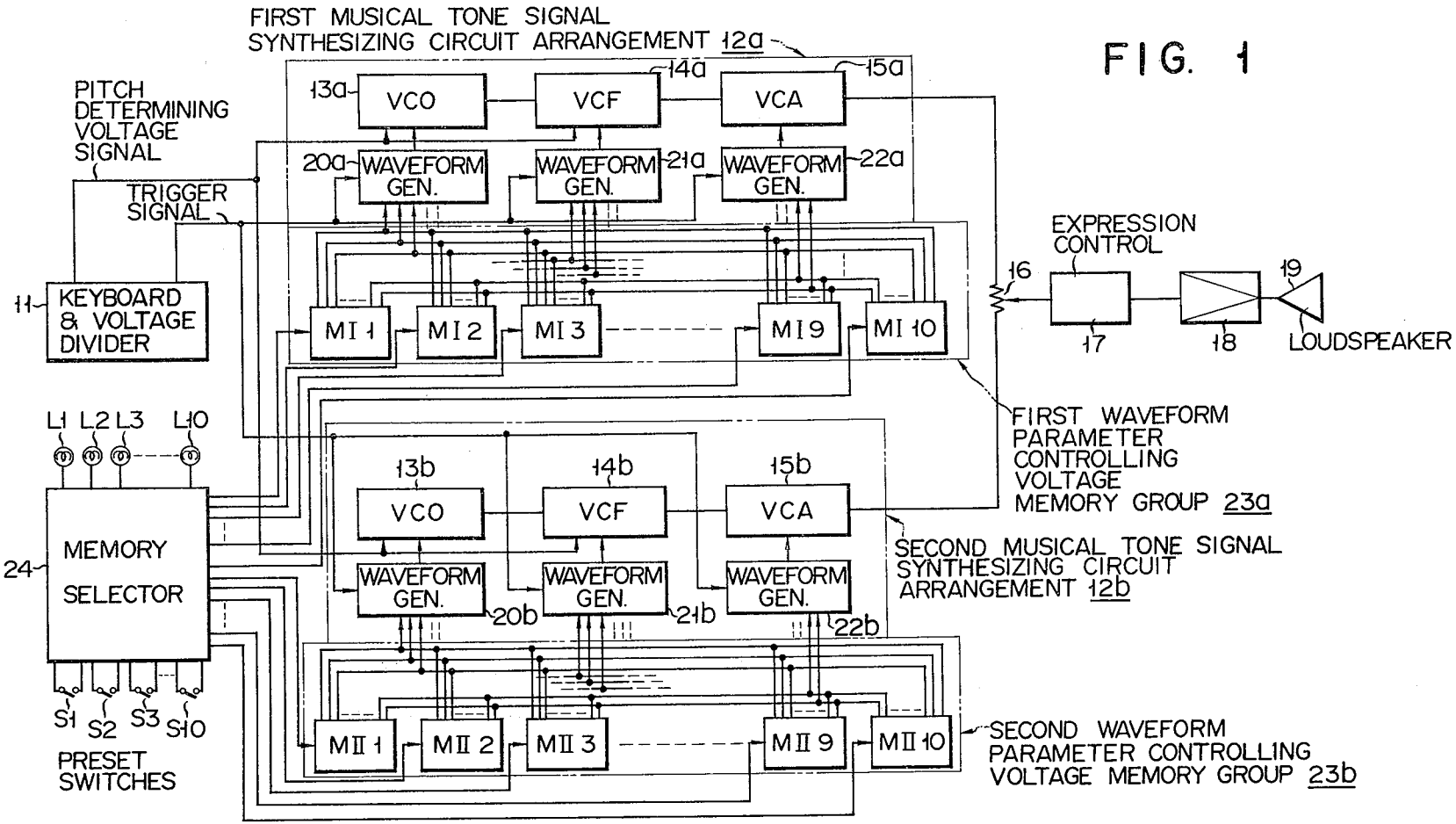
FIG. 1
LOUDSPEAKER
19
18
EXPRESSION CONTROL
17
16
FIRST WAVEFORM PARAMETER CONTROLLING VOLTAGE MEMORY GROUP 23a
SECOND MUSICAL TONE SIGNAL SYNTHESIZING CIRCUIT ARRANGEMENT 12b
SECOND WAVEFORM PARAMETER CONTROLLING VOLTAGE MEMORY GROUP 23b
FIRST MUSICAL TONE SIGNAL SYNTHESIZING CIRCUIT ARRANGEMENT 12a
VCA
VCF
VCO
WAVEFORM GEN.
15a
14a
13a
22a
21a
20a
MI 1
MI 2
MI 3
MI 9
MI 10
15b
14b
13b
22b
21b
20b
MII 1
MII 2
MII 3
MII 9
MII 10
PITCH DETERMINING VOLTAGE SIGNAL
TRIGGER SIGNAL
KEYBOARD & VOLTAGE DIVIDER
11
L1 L2 L3 L10
MEMORY SELECTOR
24
S1 S2 S3 S10
PRESET SWITCHES

ELECTRONIC MUSICAL INSTRUMENT HAVING PRESET ARRANGEMENT WITH ONE GROUP OF SWITCHES CONTROLLING TWO GROUPS OF MEMORIES

BACKGROUND OF THE INVENTION

This invention relates to an electronic musical instrument, and more particularly to a synthesizer type electronic musical instrument.

The specification of U.S. Pat. No. 3,886,836, issued on June 3, 1975 to Teruo Hiyoshi and assigned to the same assignee as the present invention, discloses a synthesizer type electronic musical instrument having a parameter controlling voltage generator capable of varying control waveform shapes for controlling the generation modes such as the tone pitch, tone color and envelope of a musical tone signal to be generated.

In order to enhance a musical performance effect in such an electronic musical instrument, a proposal has been made to connect two musical tone signal synthesizing circuit arrangements in parallel with a keyboard section so as to enable different musical tone signals to be synthesized from the two musical tone signal synthesizing circuit arrangements by operating a single key on the keyboard section to provide the couple effect. To this end, it is desirable to arbitrarily control the variable parameters of control voltage waveforms in each of the musical tone signal synthesizing circuit arrangements. It is also desirable, from the standpoint of easy operation during a musical performance, to provide a plurality of variable or fixed memories adapted to store information for controlling the variable parameters, and to selectively couple any one of memories to control waveform generators by a preset operation. Where, however, the two tone signal generating circuit arrangements are provided it is undesirable, from the standpoint of operation during the musical performance, to provide as many preset switches as the memories included in both the musical tone signal synthesizing circuit arrangements.

SUMMARY OF THE INVENTION

It is accordingly the object of this invention to provide an electronic musical instrument capable of selecting the generation modes of musical tone signals to be generated from two musical tone signal generating circuit arrangements, by preset switches corresponding in number to memories which are provided in each of the musical tone signal generating circuit arrangements.

An electronic musical instrument according to the present invention comprises first and second musical tone signal generating circuit arrangements which may be connected to a single keyboard section in parallel with each other. The generation modes such as tone pitch, tone color and envelope of first and second musical tone signals to be generated by the first and second musical tone signal generating circuit arrangements are controlled by musical tone signal controlling information coupled to the first and second musical tone signal generating circuit arrangements. There are provided first and second memory groups for the first and second musical tone signal generating circuit arrangements, respectively, each memory group including a plurality of memories storing the musical tone signal controlling information. Each memory is operative, when selectively enabled, to couple the musical signal controlling information stored therein to the musical tone signal generating circuit arrangement. There is further provided a memory selector coupled to the first and second memory groups and a plurality of preset switches the number of which equals to that of memories in each of the first and second memory groups. The memory selector operates, in response to the actuation of at least two preset switches, to selectively enable the respective ones in the first and second memory groups.

BRIEF DESCRIPTION OF THE DRAWINGS

FIG. 1 is a block diagram of an electronic musical instrument according to one embodiment of this invention;

DESCRIPTION OF THE PREFERRED EMBODIMENTS

Figure 4:
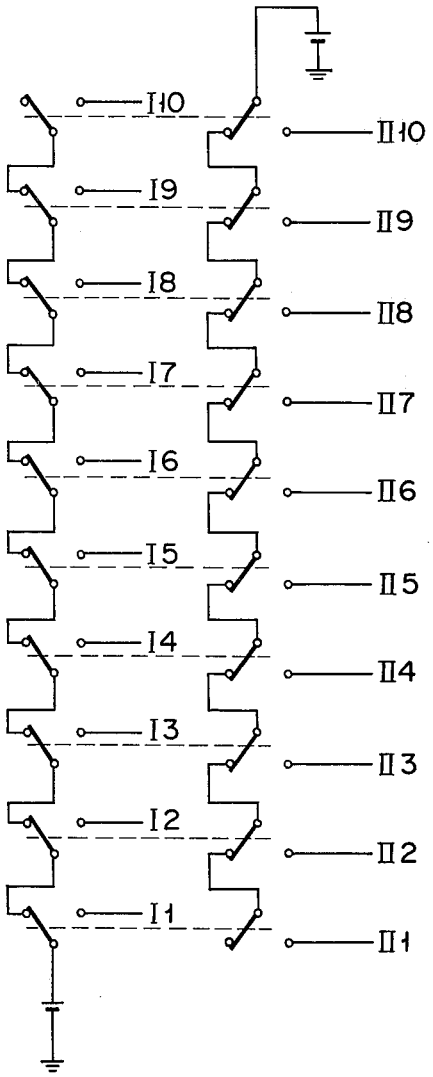
FIG. 4 is a diagram useful in understanding the operation of the memory selector in FIG. 3.

In FIG. 1, the reference numeral 11 is a known keyboard section including a voltage divider network. The keyboard section 11 generates a pitch determining voltage signal having a magnitude representing the note of a key operated on a keyboard and a trigger signal indicating the key operation. First and second musical tone signal synthesizing circuit arrangements 12*a* and 12*b* are connected to the keyboard section 11 in parallel with each other. The pitch determining voltage signal from the keyboard section 11 is coupled to voltage-controlled oscillators (hereinafter referred to as VCO) 13*a* and 13*b* of the first and second musical tone signal synthesizing circuit arrangements 12*a* and 12*b*, respectively, to generate a frequency corresponding to the voltage value of the pitch determining voltage signal. The tone signals of the VCO's 13*a* and 13*b* are coupled to voltage-controlled filters 14*a* and 14*b* (hereinafter referred to as VCF) for coloring the tone signals. The pitch determining voltage signal of the keyboard section 11 is also coupled to the VCF's 14*a* and 14*b* so that they are caused to have a cutoff frequency or frequencies corresponding to the voltage value of the pitch determining voltage signal. The tone colored signals from the VCF's 14*a* and 14*b* are coupled to voltage controlled amplifiers (hereinafter referred to as VCA) 15*a* and 15*b* of the first and second musical tone signal synthesizing circuits 12*a* and 12*b*, respectively to have their signal amplitudes, i.e. envelopes, controlled. The output signals of the VCA's 15*a* and 15*b* are mixed by a mixer 16 and then coupled through an expression control 17 and amplifier 18 to a loudspeaker 19.

Control voltage waveforms from control voltage waveform generators 20*a*, 21*a* and 22*a* are coupled to the VCO 13*a*, VCF 14*a* and VCA 15*a*, respectively, whereas control voltage waveforms of control voltage waveform generators 20*b*, 21*b* and 22*b* are coupled to the VCO 13*b*, VCF 14*b* and VCA 15*b*, respectively. That is, the VCO's 13*a* and 13*b* change their oscillation frequency according to the shape of the control voltage waveform; VCF's 14*a* and 14*b*, their cutoff frequency or frequencies; and the VCA's 15*a* and 15*b*, their gain to thereby change the envelope of the musical tone signal. The VCA's 15*a* and 15*b* are normally in the cutoff state and enable the tone colored signals to pass through in response to the control waveforms applied from the waveform generators 22*a* and 22*b*.

The above-mentioned control waveform generators initiate a waveform generation upon receipt of the trigger signal from the keyboard section 11. The control voltage waveform has parameters such as an initial level, attack time, attack level, first decay time, sustain level and second decay time. The control voltage waveforms to the VCO and VCF may have the similar shape. For example, upon the depression of the key, the control voltage waveform rises from an initial level up to an attack level in an attack time; decays down to a normal (sustain) level in a first decay time; then sustains at the normal level until the release of the key; and decays down to the initial level in a second decay time. For the control voltage waveform to the VCA, the voltage value rises from a cutoff (initial) level up to a peak (attack) level in an attack time; decays down to a sustain level in a first decay time; then sustains at a sustain level until the release of the key; and then decays down to the cutoff level in a second decay time. The control voltage waveform generators are all of a voltage-controlled type and are operative to control various waveform parameters in response to the parameter controlling voltage signals of the parameter controlling voltage generator. According to this invention, first and second waveform parameter controlling voltage memory groups 23*a* and 23*b* are provided, the former including, for example, ten memories MI1, MI2 . . . . MI9 and MI10 each adapted to store parameter controlling information for the first control waveform generators 20*a*, 21*a* and 22*a* in the first musical tone signal synthesizing circuit arrangement 12*a*; the latter including, for example, ten memories MII1, MII2 . . . . MII9 and MII10 each adapted to store parameter controlling information for the second control waveform generators 20*b*, 21*b* and 22*b* in the second musical tone signal synthesizing circuit arrangement 12*b*. Any one memory of each of the first and second memory groups 23*a* and 23*b* is selectively enabled by a memory selector 24 to which are connected ten self-return (temporary) type preset switches S1 to S10. When, for example, the preset switches S1 and S2 are actuated, the memory selector 24 operates to couple, in a predetermined preference order, a supply voltage or an enabling signal to the memories MI1 and MII2 in the first and second memory groups 23*a* and 23*b*, respectively, which correspond to the preset switches S1 and S2, respectively. As a consequence, the waveform parameter controlling voltage information stored in the selected memories MI1 and MII2 are coupled to corresponding waveform generators 20*a* to 22*a* and 20*b* to 22*b*, respectively. The indicators or lamps L1 to L10 may be connected to the memory selector 24 so as to display the selected memories.

It will be noted that although in the embodiment shown in FIG. 1 the same pitch determining voltage signal is coupled to the first and second musical tone signal synthesizing circuit arrangements 12*a* and 12*b*, different first and second musical sounds can be produced by different control voltage waveforms. Of course, the first and second VCO's 13*a* and 13*b* may be designed so as to produce somewhat different frequencies by the same pitch determining voltage signal. Furthermore, since the parameter controlling information stored in any one memory of each of the first and second memory groups can be selectively applied to the corresponding musical tone signal synthesizing circuit arrangement, it is possible to provide a very diversified musical performance. In another aspect of this invention it is possible to provide two keyboard sections which are coupled to the first and second musical tone signal synthesizing circuit arrangements, respectively.

Figure 2:
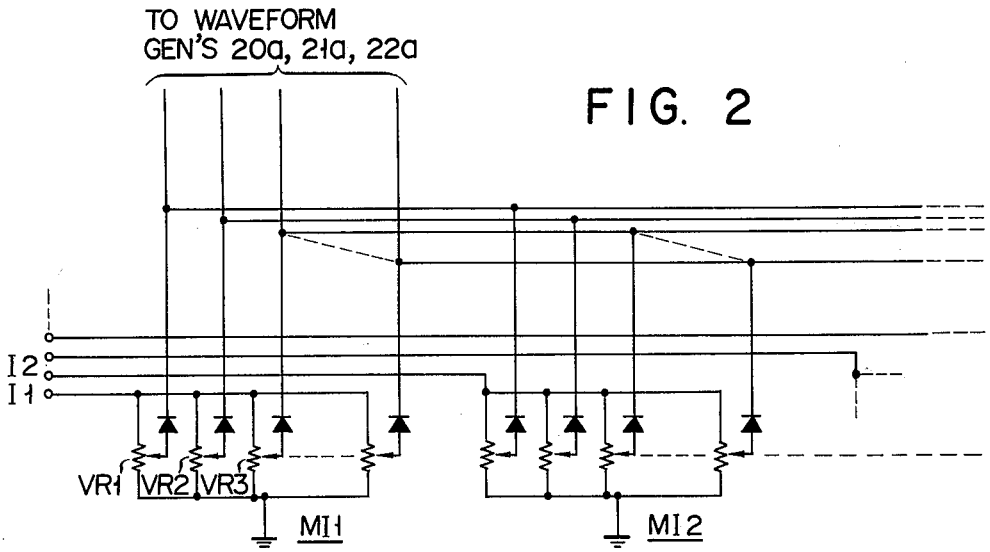
FIG. 2 is a circuit arrangement of an example of memories in FIG. 1.

As shown in FIG. 2 each of the waveform parameter controlling information memories can be constituted by variable resistors, or potentiometers, VR1, VR2 . . . each of which is capable of setting a certain control voltage. When a memory is selected by the memory selector 24, a DC voltage is applied from the memory selector to the selected one of memory input terminals I1, I2 . . . . in a memory group. As a result, the selected memory is enabled to supply parameter controlling voltage signals or musical tone controlling signals stored therein to the control voltage waveform generators. The memories may be of a fixed type which uses fixed resistors.

The memory selector will now be explained by reference to FIG. 3. To a power source (+15 volts) are coupled the preset switches S1 to S10 corresponding to the memories MI1 to MI10 and MII1 to MII10, respectively, for the first and second musical tone signal synthesizing circuit arrangements 12*a* and 12*b*. The preset switches S1 to S10 are assigned with the same order as the memories MI1 to MI10 and MII1 to MII10.

The preset switches S1 to S10 are coupled through corresponding gates G1 to G10 to a lower order preference circuit 25 and higher order preference circuit 26. The gates G1 to G10 are rendered conductive by a pulse signal having a period of about 10 m sec from an oscillator 27. The period is selected considering that, even when the two preset switches are simultaneously actuated or released, a time difference will inevitably exist and the maximum time difference will be about 10 m sec at most. When any one of the preset switches S1 to S10 is actuated, an enabling signal appears at the output terminals of the preference circuits 25 and 26 which are assigned the same order as that of the actuated switch, thus enabling the memory having the corresponding order in each of the first and second memory groups 23*a* and 23*b*. Where two preset switches, for example, S4 and S5 are actuated, outputs appear at the output terminal I4 of the lower order circuit 25 as corresponding to the preset switch S4 and at the output terminal II5 of the higher order circuit 26 as corresponding to the preset switch S5. As a result, the corresponding memory MI4 in the first memory group 23*a* and corresponding memory MII5 in the second memory group 23*b* are selectively enabled to cause information stored in the respective memories to be coupled to the corresponding waveform generators 20*a* to 22*a* and 20*b* to 22*b*, respectively.

By the outputs of the preference circuits 25 and 26, switching transistors are turned ON in a lamp driver circuit 28 which are connected in series with lamps L4 and L5 across a power source, respectively, thereby lighting the lamps L4 and L5 corresponding to the selected memories MI4 and MII4. Although the preset switches S1 to S10 are of the self-return type, the outputs of the preference circuits are held even after the release of the switches until different switches are actuated. If after actuation of two preset switches a time difference exists in releasing them, the preference circuits 25 and 26 are both established by the later released preset switch, and hence the selection operation effected by the earlier released preset switch is nullified. In order to avoid such an erroneous operation, the gates G1 to G10 are provided.

Figure 3:
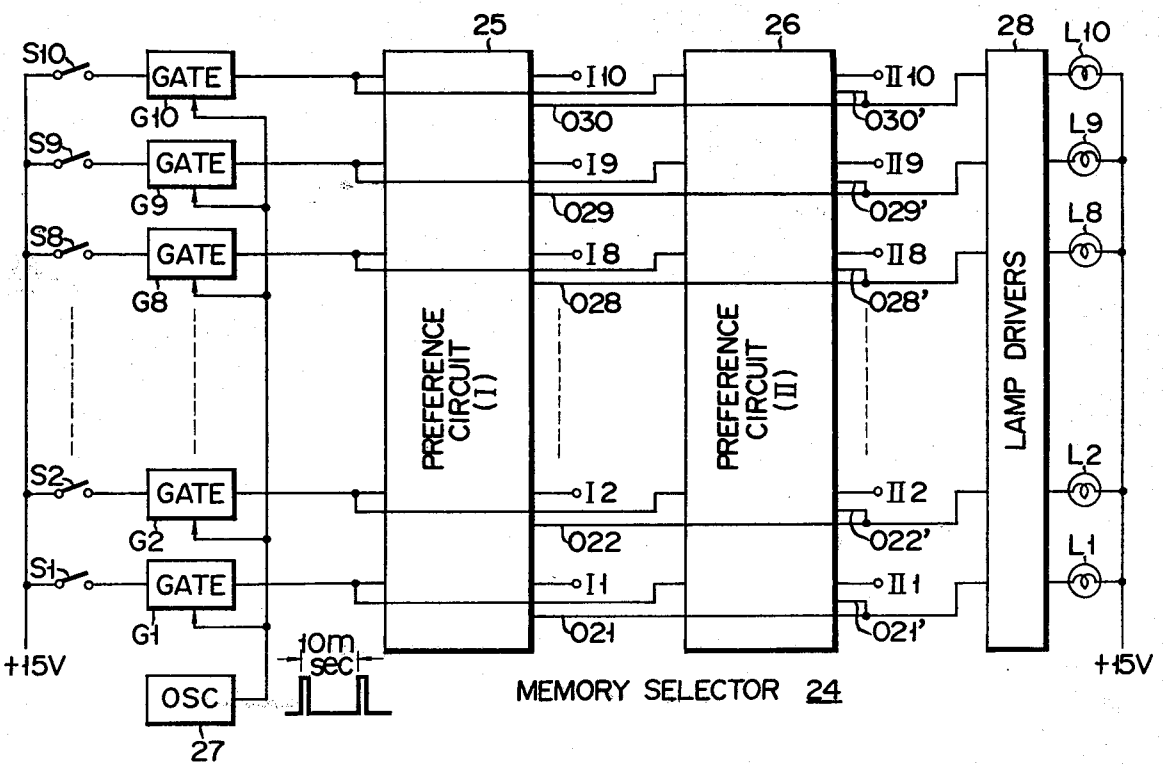
FIG. 3 is a block diagram of a memory selector in FIG. 1.

The lower and the higher order preference circuits shown in FIG. 3 are equivalent in operational principle to preference circuits, as shown in FIG. 4, using single-pole double-throw switches associated with each other in a latch (lock-release) fashion. In the preference circuit shown in FIG. 4 a switch arrangement on the left side corresponds to the lower order preference circuit, and a switch arrangement on the right side, the higher order preference circuit. The switch in one switching arrangement is ganged with a corresponding switch in the other switching arrangement.

Figure 5:
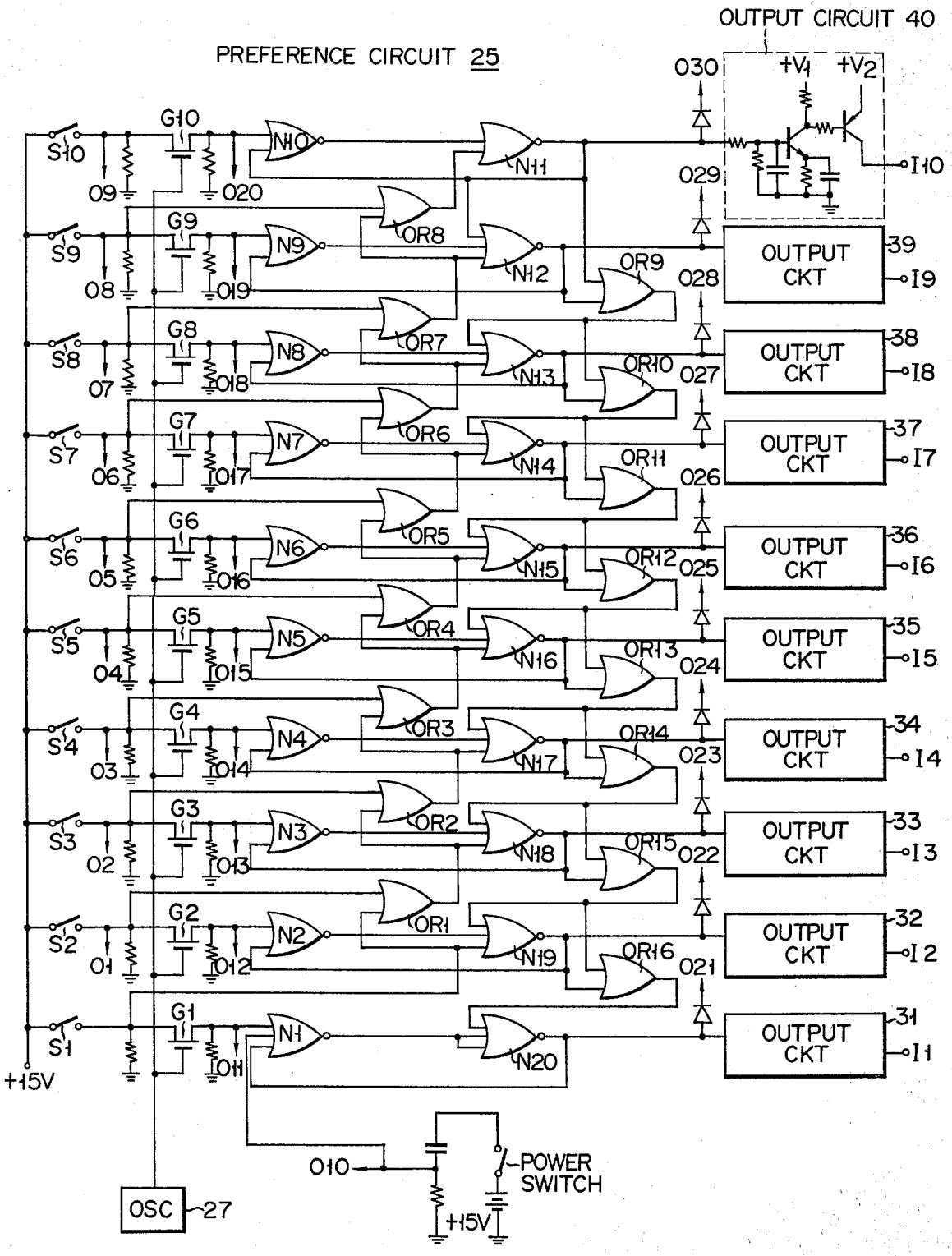
FIG. 5 is a block diagram of an example of the preference circuit I in FIG. 3.
Figure 6:
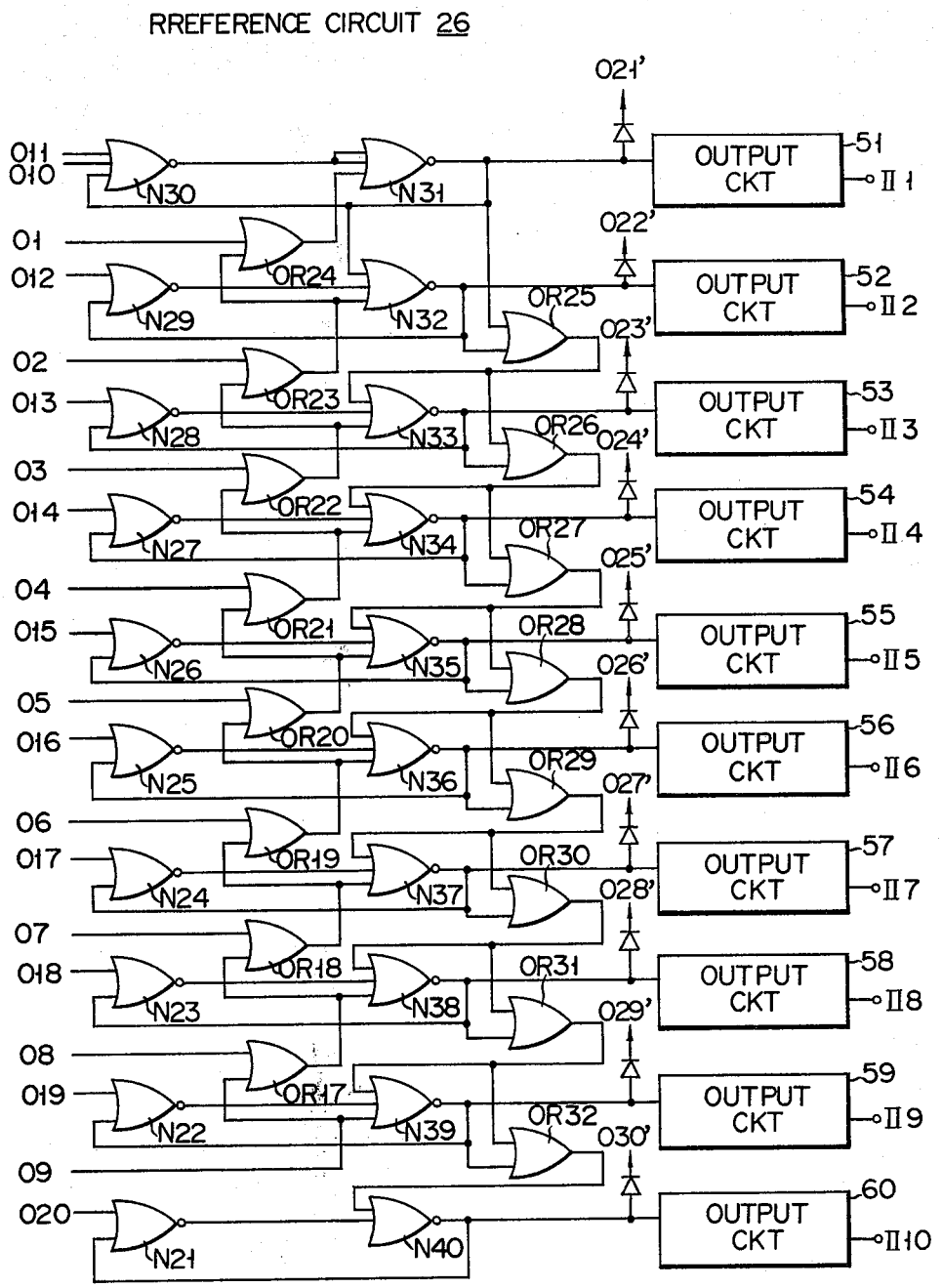
FIG. 6 is a block diagram of an example of the preference circuit II in FIG. 3.

FIGS. 5 and 6 show, by way of example, the details of the lower and the higher order preference circuits each having a self-holding function. The signals 01 to 020 in FIG. 5 are respectively coupled to terminals 01 to 020 in FIG. 6. Suppose, for example, that the preset switches S4 and S5 are closed. Then, a supply voltage (+15 volts) is applied to OR circuits OR3 and OR4 to produce the outputs of a logical 1 level (positive logic system). In consequence, the outputs of OR circuits OR5 to OR8 also become the logical 1 level. The outputs of NOR circuits N11 to N16, on the other hand, become a logical 0 level in response to the output 1 of the OR circuits OR3 to OR8, and thus the outputs of OR circuits OR9 to OR13 become a logical 0 level. When the gates G1 to G10 are enabled by the output of the oscillator 27, the outputs of NOR circuits N4 and N5 become a logical 0 level, whereas the outputs of NOR circuits N1 to N3 and N6 to N10 become a logical 1 level. Since the outputs of the NOR circuit 16 and OR circuits OR2 and OR13 are all at a logical 0 level, the output of an NOR circuit 17 becomes a logical 1 level. The output of the NOR circuit N17 is fed back to the NOR circuit N4 and hence the output of the NOR circuit N17 is the logical 1 level even when the gate G4 is disabled or the preset switch S4 is released. That is, when the preset switches S4 and S5 are actuated, the output of the NOR circuit 17 becomes a logical 1 level and the output of the NOR circuit 16 becomes a logical 0 level. The output of the NOR circuit 17 is applied to a fourth output circuit 34 in output circuits 31 to 40, which in turn generates an output voltage at an output terminal I4. The output voltage is +V2 volts as will be evident from the output circuit 40 at the top of FIG. 5. It will be understood that a circuit arrangement in FIG. 5 is operated as a lower order preference circuit.

The higher order preference circuit 26 will now be explained by reference to FIG. 6. When the preset switches S4 and S5 are actuated, the outputs of OR circuits OR21 and OR22 become a logical 1 level and, hence, the outputs of OR circuits OR23 and OR24 become a logical 1 level. The outputs of NOR circuits N31 to N34 become a logical 0 level. Likewise, the outputs of OR circuits OR25 to OR27 become a logical 0 level. The outputs of OR circuits OR17 to OR20 are a logical 0 level. When the gates G4 and G5 are enabled, the outputs of NOR circuits N26 and N27 become a logical 0 level. Since the outputs of the NOR circuit N26 and OR circuits OR20 and OR27 are all in a logical 0 level, the output of an NOR circuit N35 becomes a logical 1 level. The output of the NOR circuit N35 is fed back to the NOR circuit 26 and hence, the logical 1 output of the NOR circuit N35 is maintained.

As already mentioned above, when the preset switches S4 and S5 are actuated, among output circuits 51 to 60 only the fifth output circuit 55 is driven to generate an output at an output terminal I15. It will be appreciated that the circuit arrangement is operated as a higher order preference circuit. As shown in FIG. 3, a plurality of paired outputs 021,021′; 022,022′; . . . . ; 030,030′ of FIGS. 5 and 6 are coupled to a corresponding common lamp driver transistor in the lamp driver 28.

What is claimed is:

1. An electronic musical instrument comprising:

first and second sources of musical tone controlling information;

a first musical tone signal generating circuit arrangement coupled to said first source for generating a first musical tone signal the generation mode of which is controlled by said musical tone controlling information;

a second musical tone signal generating circuit arrangement coupled to said second source for generating a second musical tone signal the generation mode of which is controlled by said musical tone controlling information;

musical sound reproducing means coupled to outputs of said first and second tone signal generating circuit arrangements;

said first source of musical tone controlling information including a first memory group having N memories assigned with the order of 1 to N, each memory being adapted to store the musical tone controlling information for controlling the first musical tone signal of said first musical tone signal generating circuit arrangement, and being operative to, when selectively enabled, couple the musical tone controlling information to said first musical tone signal generating circuit arrangement;

said second source of musical tone controlling information including a second memory group having N memories assigned with the order of 1 to N, each memory being adapted to store the musical tone controlling information for controlling the second musical tone signal of said second musical tone signal generating circuit arrangement, and being operative to, when selectively enabled, couple the musical tone controlling information to said second musical tone signal generating circuit arrangement;

N preset switches assigned with the order of 1 to N; and means coupled to said preset switches and said first and second memory groups for selectively enabling, when at least two preset switches are actuated, the memory in said first memory group which is assigned with the same order as that of one of the actuated switches and the memory in said second group which is assigned with the same order as that of another of the actuated switches.

2. An electronic musical instrument according to claim 1 further comprising indicator means coupled to said last-mentioned memory enabling means for indicating selected memories in said first and second memory groups in response to outputs of said last-mentioned means when said preset switches are actuated.

3. An electronic musical instrument comprising:

a keyboard section for generating in response to key operation a pitch determining voltage signal having a magnitude representing the note of a depressed key and a trigger signal indicating the key operation;

a first musical tone signal generating circuit arrangement coupled to said keyboard section to generate a first musical tone signal in response to the pitch determining voltage signal from said keyboard section and including first voltage controlled means for controlling at least one of the tone pitch, tone color and envelope of the first musical tone signal in response to a first control voltage waveform and first control voltage generating means for generating in response to the trigger signal from said keyboard section the first control voltage waveform which is coupled to said first voltage controlled means and has a plurality of controlled parameters which determine the shape of the first control voltage waveform;

a second musical tone signal generating circuit arrangement coupled to said keyboard section to generate a second musical tone signal in response to the pitch determining voltage signal from said keyboard section and including second voltage controlled means for controlling at least one of the tone pitch, tone color and envelope of the second musical tone signal in response to a second control voltage waveform, and second control voltage waveform generating means for generating in response to the trigger signal from said keyboard section the second control voltage waveform which is coupled to said second voltage controlled means and has a plurality of controlled parameters which determine the shape of the second control voltage waveform;

musical sound reproducing means coupled to the outputs of said first and second musical tone signal generating circuit arrangements;

a first memory group having N memories assigned with the order of 1 to N, each memory being adapted to store information for controlling parameters of the first control voltage waveform and being operative to, when selectively enabled, couple the information to said first control voltage waveform generating means;

a second memory group having N memories assigned with the order of 1 to N, each memory being adapted to store information for controlling parameters of the second control voltage waveform and being operative to, when selectively enabled, couple the information to said second control voltage waveform generating means;

N preset switches assigned with the order of 1 to N; and means coupled to said preset switches and said first and second memory groups for selectively enabling, when at least two of said preset switches are actuated, the memory in said first memory group which is assigned with the same order as that of one of the actuated switches and the memory in said second group which is assigned with the same order of another of the actuated switches.

4. An electronic musical instrument according to claim 3 further comprising indicator means coupled to said last-mentioned memory enabling means for indicating selected memories in said first and second memory groups in response to outputs of said last-mentioned memory enabling means when said preset switches are actuated.

5. An electronic musical instrument comprising:

a keyboard section for generating in response to key operation a pitch determining voltage signal havng a magnitude representing the note of a depressed key and a trigger signal indicating the key operation;

a first musical tone signal synthesizing circuit arrangement comprising a first voltage-controlled oscillator means coupled to receive the pitch determining voltage signal from said keyboard section for producing a first tone signal having a pitch frequency corresponding to the note of the depressed key, a first voltage-controlled filter means coupled to receive the first tone signal from said first voltage-controlled oscillator means for imparting a tone color to the first tone signal, and first control voltage waveform generating means coupled to receive the trigger signal from said keyboard section for generating first control voltage waveforms which are coupled to said first voltage-controlled oscillator means and said first voltage-controlled filter means to control the oscillation frequency and frequency characteristics thereof respectively, the first control voltage waveforms having controlled parameters which determine the shape of the first control voltage waveforms, and a first tone signal output coupled to the output of said first voltage-controlled filter means;

a second musical tone signal synthesizing circuit arrangement comprising a second voltage-controlled oscillator means coupled to receive the pitch determining voltage signal from said keyboard section to produce a second tone signal having a pitch frequency corresponding to the note of the depressed key, a second voltage-controlled filter means coupled to receive the second tone signal from said second voltage-controlled oscillator means for imparting a tone color to the second tone signal, second control voltage waveform generating means coupled to receive the trigger signal from said keyboard section for producing second control voltage waveforms which are coupled to said second voltage-controlled oscillator means and said second voltage-controlled filter means to control the oscillation frequency and frequency characteristics thereof respectively, said second control voltage waveforms having controlled parameters which determine the shape of the second control voltage waveforms, and a second tone signal output coupled to the output of said second voltage-controlled filter means;

sound reproducing means coupled to the tone signal outputs of said first and second musical tone signal synthesizing circuit arrangements;

first memory groups including N memories which are assigned with the order of 1 to N respectively, each of said memories being adapted to store parameter controlling information to control the parameters of the first control voltage waveforms and being operative, when selectively enabled, to couple the parameter controlling information to said first control voltage waveform generating means;

second memory group including N memories which are assigned with the order of 1 to N respectively, each of said memories being adapted to store parameter controlling information to control the parameters of the second control voltage waveforms and being operative, when selectively enabled, to couple the parameter controlling information to said second control voltage waveform generating means;

N preset switches which are assigned with the order of 1 to N respectively; and means coupled to said preset switches and said first and second memory groups for selectively enabling, when at least two of said preset switches are actuated, one memory in said first memory group which is assigned with the same order as one of the actuated preset switches and one memory in said second memory group which is assigned with the same order as another of the actuated preset switches.

6. An electronic musical instrument according to claim 5 further comprising indicator means coupled to said last-mentioned memory enabling means for indicating selected memories in said first and second memory groups in response to outputs of said last-mentioned memory enabling means when said preset switches are actuated.

7. An electronic musical instrument according to claim 5 further comprising first and second voltage-controlled amplifier means respectively coupled between the outputs of said first and second voltage-controlled filter means and said first and second tone signal outputs, said first and second voltage-controlled amplifier means being operative, in response to control voltage waveforms from said first and second control voltage waveform generating means, to impart to the filtered tone signals from said first and second voltage-controlled filter means envelopes which are determined by the first and second control voltage waveforms coupled to said first and second voltage-controlled amplifier means respectively.

* * * * *

UNITED STATES PATENT AND TRADEMARK OFFICE

CERTIFICATE OF CORRECTION

PATENT NO. : 3,999,458

DATED : December 28, 1976

INVENTOR(S) : Shigeru SUZUKI

It is certified that error appears in the above-identified patent and that said Letters Patent are hereby corrected as shown below:

Column 6, line 62, before "means" insert --memory enabling--.

Signed and Sealed this

Seventeenth Day of May 1977

[SEAL]

*Attest:*

RUTH C. MASON
*Attesting Officer*

C. MARSHALL DANN
*Commissioner of Patents and Trademarks*